US010414558B2

(12) United States Patent
Kim

(10) Patent No.: US 10,414,558 B2
(45) **Date of Patent: *Sep. 17, 2019**

(54) LIQUID CONTAINER HAVING DOUBLE CAP

(71) Applicant: Hak Rae Kim, Gwangju-si (KR)

(72) Inventor: Hak Rae Kim, Gwangju-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/823,559

(22) Filed: Nov. 27, 2017

(65) Prior Publication Data

US 2018/0162610 A1 Jun. 14, 2018

(30) Foreign Application Priority Data

Dec. 12, 2016 (KR) ..... 10-2016-0169018

(51) Int. Cl.
*B65D 47/14* (2006.01)
*B65D 47/20* (2006.01)
(Continued)

(52) U.S. Cl.
CPC ..... *B65D 47/2012* (2013.01); *B65D 1/0246* (2013.01); *B65D 39/08* (2013.01); *B65D 41/04* (2013.01); *B65D 47/121* (2013.01); *B65D 47/123* (2013.01); *B65D 47/246* (2013.01); *B65D 51/18* (2013.01); *B65D 53/02* (2013.01); *B65D 81/38* (2013.01);
(Continued)

(58) Field of Classification Search
CPC .. B65D 47/241; B65D 47/142; B65D 47/121; B65D 47/122; B65D 47/246; B65D 47/245; B65D 47/263; B65D 47/247; B65D 39/08; B65D 39/14; B65D 55/165; B65D 55/16; B65D 50/061; B65D 41/0485; B65D 47/143; B65D 47/141; B65D 47/068; A47J 41/0027; A47J 41/0016
USPC ..... 220/799, 797, 800, 798, 290; 215/216, 215/306
See application file for complete search history.

(56) References Cited

U.S. PATENT DOCUMENTS 403,466 A * 5/1889 Glover ..... B65D 39/08 215/357
4,506,794 A * 3/1985 Wilson ..... B65D 50/061 215/206
(Continued)

FOREIGN PATENT DOCUMENTS

CN 204776594 U * 11/2015
GB 687895 A * 2/1953 ..... B65D 39/00
(Continued)

*Primary Examiner* — Allan D Stevens
(74) *Attorney, Agent, or Firm* — Revolution IP, PLLC

(57) ABSTRACT

A liquid container includes a container body including an inner space formed to accommodate a liquid therein and an opening formed at a top thereof to allow the liquid to flow into the inner space, an outer cap including a liquid port fastened to the opening and connected to the inner space, an inner cap inserted into the liquid port and fastened to the outer cap to open and close the liquid port to selectively connect the inner space to an outside, and a stopper fastened to the inner cap, protruding in an outward-radial direction to be held by a bottom end of the outer cap to limit a movement distance of the inner cap, and formed of an elastic material to allow the inner cap to be separable from the outer cap by a certain external force applied to the inner cap.

2 Claims, 8 Drawing Sheets

(51) Int. Cl.

| | |
|---|---|
| ***B65D 47/12*** | (2006.01) |
| ***B65D 39/08*** | (2006.01) |
| ***B65D 51/18*** | (2006.01) |
| ***B65D 53/02*** | (2006.01) |
| ***B65D 1/02*** | (2006.01) |
| ***B65D 81/38*** | (2006.01) |
| ***B65D 41/04*** | (2006.01) |
| ***B65D 47/24*** | (2006.01) |

(52) U.S. Cl.
CPC ..... *B65D 2251/0015* (2013.01); *B65D 2251/0087* (2013.01); *B65D 2501/0009* (2013.01); *B65D 2547/066* (2013.01)

(56) References Cited

U.S. PATENT DOCUMENTS

| | | | | | |
|---|---|---|---|---|---|
| 4,582,218 | A * | 4/1986 | Ross | A47G 19/12 215/307 |
| D836,388 | S * | 12/2018 | Abante | D7/392.1 |
| D836,389 | S * | 12/2018 | Abante | D7/392.1 |
| 2003/0209574 | A1* | 11/2003 | Lin | B65D 41/0442 222/548 |
| 2015/0232232 | A1* | 8/2015 | Shibuki | B65D 25/14 220/592.16 |
| 2017/0081090 | A1* | 3/2017 | Boyer | B65D 47/121 |
| 2018/0105346 | A1* | 4/2018 | Tolman | B65D 81/3869 |

FOREIGN PATENT DOCUMENTS

| | | | |
|---|---|---|---|
| JP | 2006-259759 | A | 9/2006 |
| KR | 10-1581270 | B1 | 1/2016 |
| KR | 10-1668309 | B1 | 10/2016 |

* cited by examiner

LIQUID CONTAINER HAVING DOUBLE CAP

CROSS-REFERENCE TO RELATED APPLICATION

This application claims priority to and the benefit of Korean Patent Application No. 10-2016-0169018 filed on Dec. 12, 2016, the disclosure of which is incorporated herein by reference in its entirety.

BACKGROUND

1. Field of the Invention

The present invention relates to a liquid container, and more particularly, to a liquid container including a double cap structure with a separable inner cap.

2. Discussion of Related Art

Generally, a thermos bottle is an insulation container manufactured for maintaining a drink therein at the same temperature for a long time. There are various types of thermos bottles in the market.

Among these thermos bottles, there is a thermos bottle including a double cap structure to discharge a drink stored in the thermos bottle in a state of securing a maximum thermal insulation property.

A thermos bottle including a double cap structure includes an outer cap fastened to a container body and an inner cap provided to open and close a flow path formed at the outer cap.

The above thermos bottle including the double cap structure is configured to discharge a drink through a gap formed between the inner cap and the outer cap when the inner cap is slightly opened.

However, in the related art, a cap is partially twisted and discharges only in a determined direction. Also, since an opening degree of the cap is not determined, when the cap is twisted too much and tilted to discharge a drink, the cap may be separated and content may be spilt such that there is a danger of burn with a hot drink or contaminating a nearby place.

Also, when the container body is tilted, the cap leans due to a weight of the cap in a direction in which the container body is tilted. Accordingly, since it is difficult to provide a flow path, a liquid therein is not easily discharged.

SUMMARY OF THE INVENTION

The present invention is provided to overcome limitations of the related art, and aspects of the present invention are as follows.

One aspect of the present invention provides a liquid container including a double cap structure capable of preventing an inner cap from being separated when a container body is tilted to discharge a liquid.

Another aspect of the present invention provides a liquid container including a double cap structure capable of discharging a liquid in all directions of 360 degrees.

Still another aspect of the present invention provides a liquid container including a double cap structure in which an inner cap is not separated when a liquid is discharged but is separable when a certain external force is applied to the inner cap for washing, refilling with a drink, replacing of components, and the like.

Aspects of the present disclosure will not be limited to the above-mentioned aspects and other unmentioned aspects will be clearly understood by those skilled in the art from the following description.

According to one aspect of the present invention, a liquid container including a double cap structure includes a container body, an outer cap, an inner cap, and a stopper.

The container body may include an inner space which accommodates a liquid therein and an opening formed at a top thereof to allow the liquid to flow into the inner space.

The outer cap includes a liquid port fastened to the opening and connected to the inner space.

The inner cap is inserted into the liquid port and fastened to the outer cap to open and close the liquid port to selectively connect the inner space to an outside.

The stopper is fastened to the inner cap, protrudes in an outward-radial direction, and is held by a bottom end of the outer cap to limit a movement distance of the inner cap. Also, the stopper is formed of an elastic material such that the inner cap is separable from the outer cap by a certain external force applied to the inner cap.

The inner cap may include an insertion portion inserted into the liquid port and located in the outer cap and a handle portion located above the insertion portion and exposed outward from the outer cap to be gripped by a user to rotate the inner cap.

An extraction flow path opened and closed according to an opening and closing operation of the inner cap may be formed on an outer circumferential surface of the insertion portion.

The extraction flow path may have a length in a height direction of the inner cap and may have a groove shape recessed toward an inside of the inner cap.

The outer cap and the insertion portion may be fastened by screw-coupling.

A holding protrusion extended along an inner diameter and formed to protrude toward an inside of the liquid port may be formed at a bottom of the outer cap. When the inner cap is completely closed, the holding protrusion and the inner cap come into contact with each other such that inflow and outflow of the liquid may be cut off. When the inner cap is opened, the stopper is held by the holding protrusion such that the inner cap may be prevented from being separated from the outer cap.

The inner cap may include a first sealing portion which has elasticity at a part in contact with the holding protrusion to be compressed by the holding protrusion to seal the inner space when the inner cap is completely closed.

The first sealing portion may be pressurized by the holding protrusion and deformed in an inward-radial direction to increase a sealing effect when the inner cap is completely closed.

A second sealing portion formed of an elastic material between the insertion portion and the handle portion, extended along an outer diameter to protrude outward to come into contact with an inner circumferential surface of the liquid port and be compressed to cut off inflow and outflow of the liquid when the inner cap is completely closed, and configured to open a part of the liquid port when the inner cap is opened may be formed.

An upper part of the liquid port may be formed to allow a diameter thereof to get increased to the top.

A stopper accommodation groove in which the stopper is accommodated may be formed around the liquid port on a bottom surface of the holding protrusion to prevent a horizontal movement of the stopper such that the inner cap may be located in the center of the liquid port.

BRIEF DESCRIPTION OF THE DRAWINGS

The detailed description of exemplary embodiments of the present invention, which will be described below, and the summary described above will be better understood with reference to the attached drawings. The exemplary embodiments of the present invention are shown in the drawings to exemplify the present invention. However, it should be understood that the present application is not limited to accurate arrangements and means shown in the drawings, in which.

DETAILED DESCRIPTION OF EXEMPLARY EMBODIMENTS

Hereinafter, embodiments of the present invention will be described in detail with reference to the attached drawings. However, it will be easily understood by one of ordinary skill in the art that the attached drawings are provided to easily disclose the content of the present invention and the scope of the present invention is not limited to the attached drawings.

Also, it should be noted that throughout the description, like elements having the same function will be referred to as like designations and like references but are actually not the same as elements of the related art.

Also, the terms used herein are used merely to describe particular embodiments and are not intended to limit the present invention. Singular forms, unless defined otherwise in context, include plural forms. Throughout the specification, it should be understood that the terms "comprise", "have", and the like are used herein to specify the presence of stated features, numbers, steps, operations, elements, components or combinations thereof but do not preclude the presence or addition of one or more other features, numbers, steps, operations, elements, components, or combinations thereof.

Hereinafter, a liquid container including a double cap structure according to one embodiment of the present invention will be described with reference to the drawings.

Figure 1:
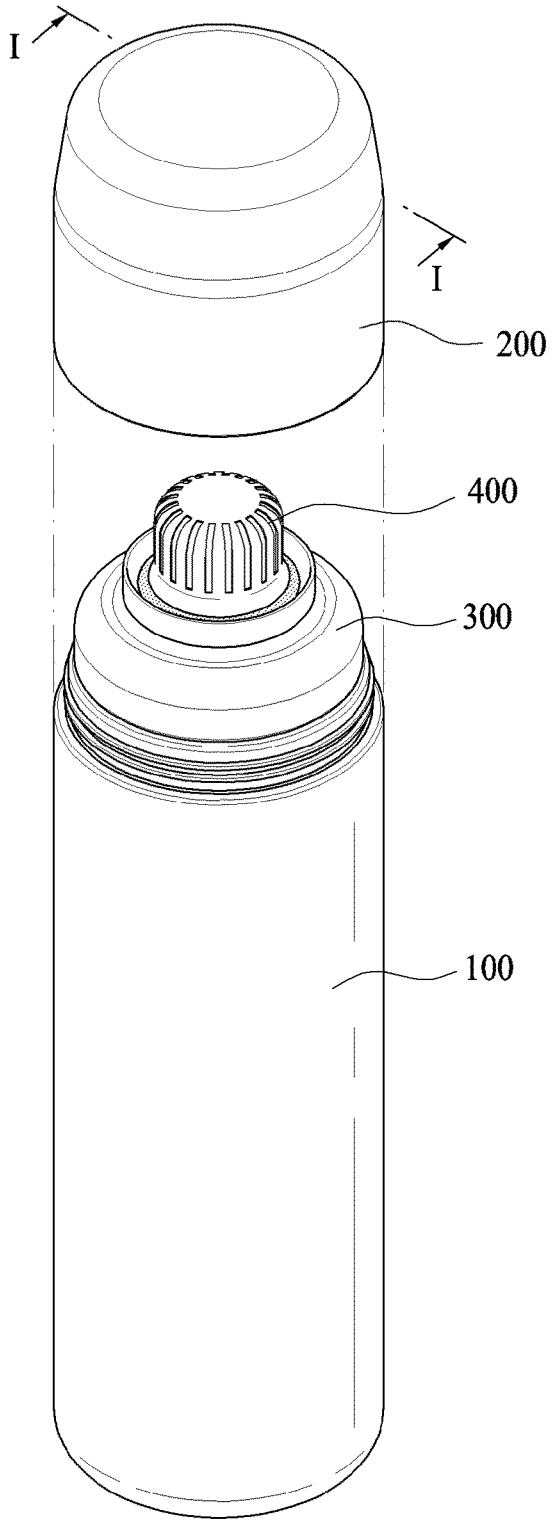
FIG. 1 is a perspective view of a liquid container including a double cap structure according to one embodiment of the present invention.
Figure 2:
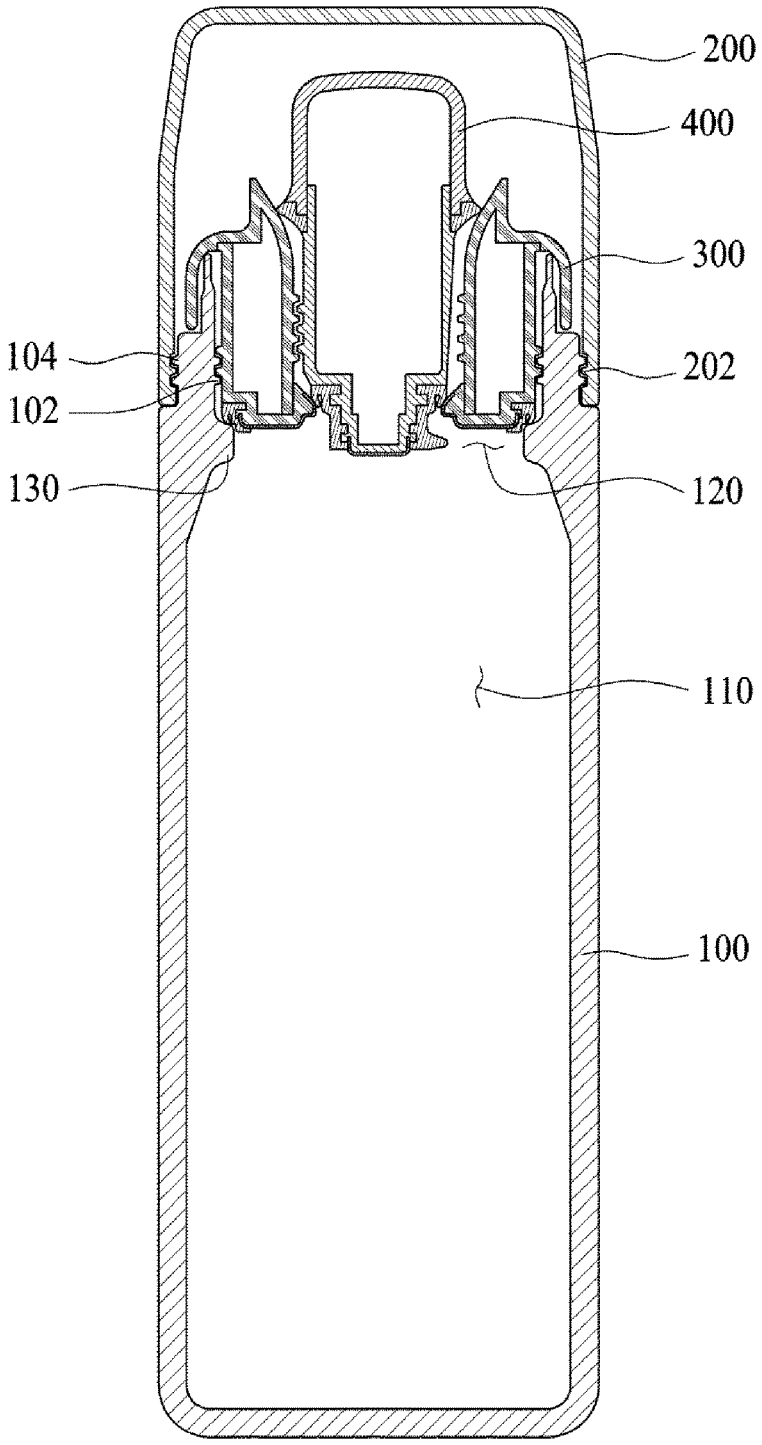
FIG. 2 is a cross-sectional view of the liquid container including the double cap structure according to one embodiment of the present invention taken along line I-I of FIG. 1.
Figure 3:
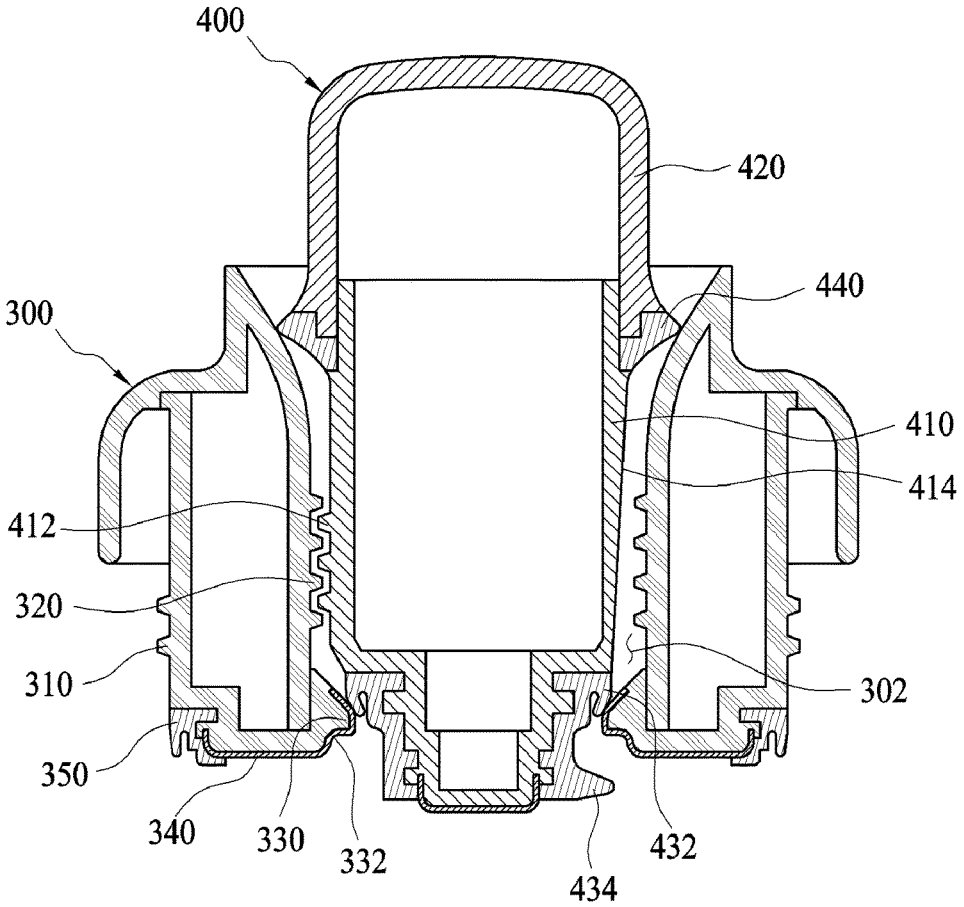
FIG. 3 is a cross-sectional view taken along line I-I of FIG. 1 illustrating a state in which an inner cap of the liquid container including the double cap structure according to one embodiment of the present invention is closed.
Figure 4:
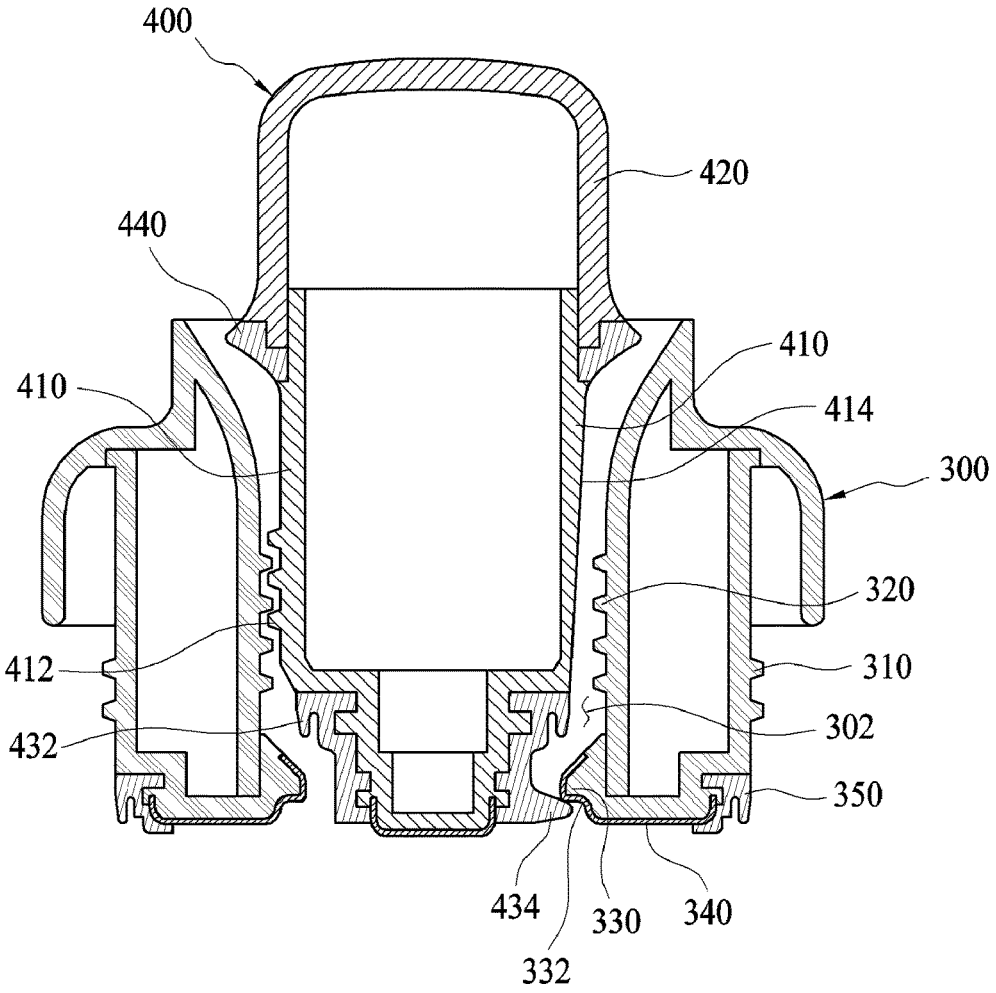
FIG. 4 is a cross-sectional view taken along line I-I of FIG. 1 illustrating a state in which the inner cap of the liquid container including the double cap structure according to one embodiment of the present invention is opened.
Figure 5:
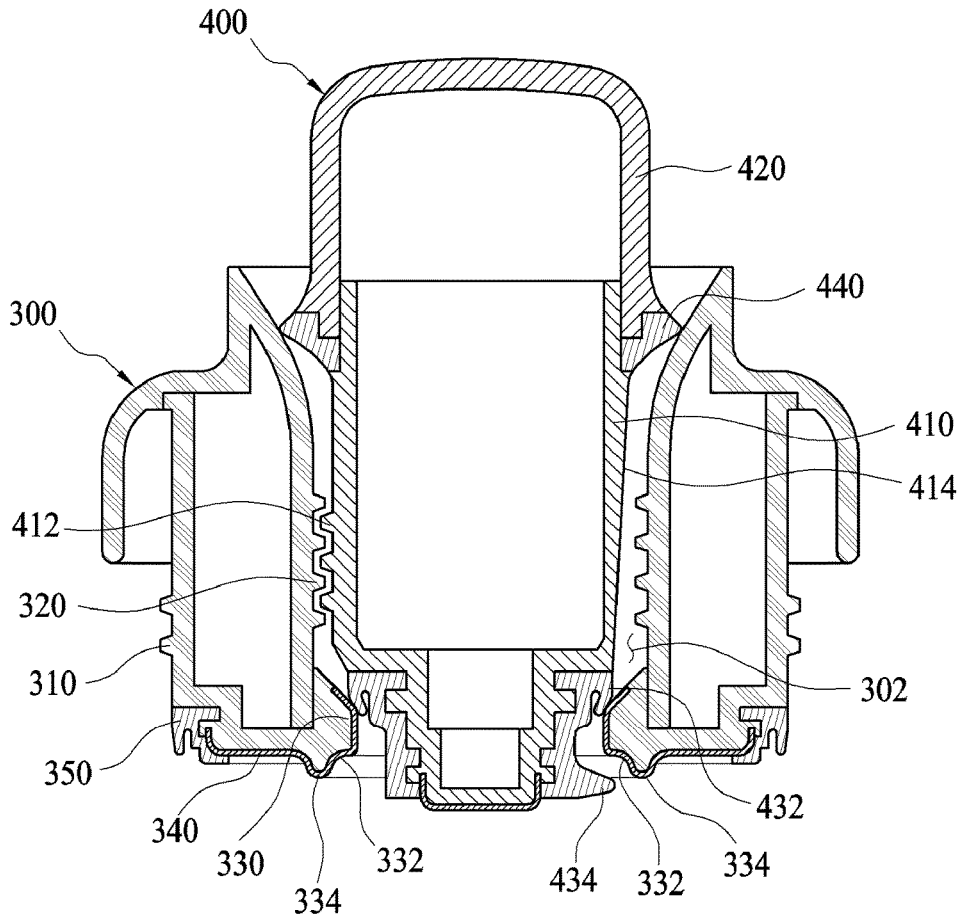
FIG. 5 is a cross-sectional view taken along line I-I of FIG.1 illustrating another example of a stopper accommodation groove of the liquid container including the double cap structure according to one embodiment of the present invention.
Figure 6:
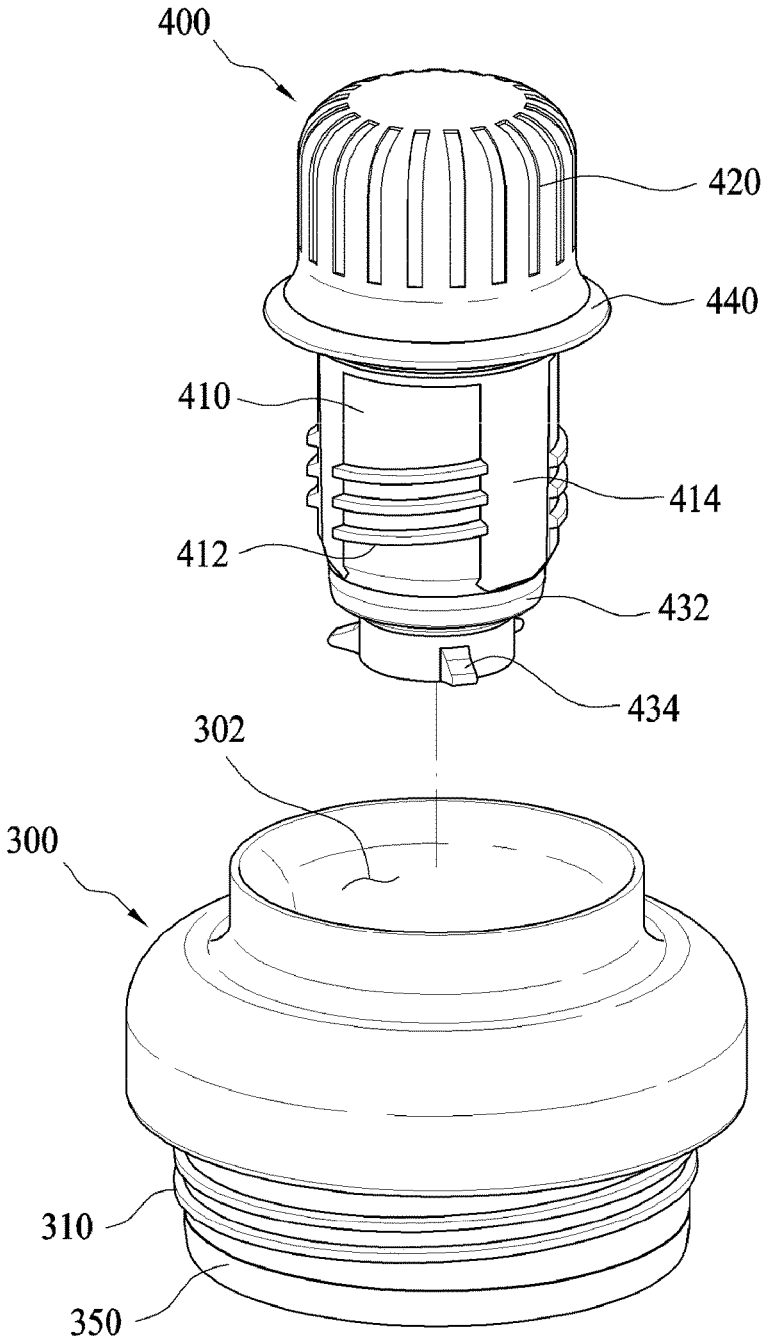
FIG. 6 is an exploded perspective view illustrating an outer cap and the inner cap of the liquid container including the double cap structure according to one embodiment of the present invention.
Figure 7:
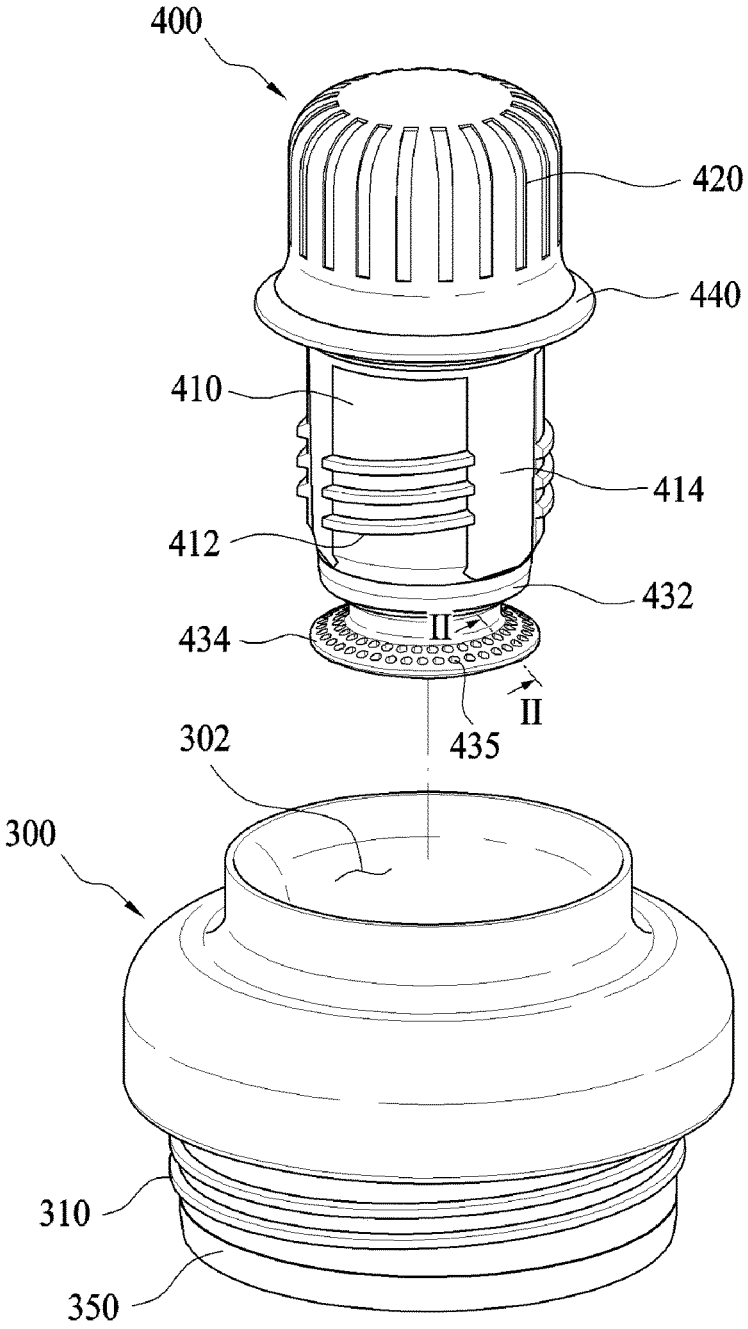
FIG. 7 is an exploded perspective view illustrating another example of a stopper of the liquid container including the double cap structure according to one embodiment of the present invention.

FIG. 1 is a perspective view of a liquid container including a double cap structure according to one embodiment of the present invention, FIG. 2 is a cross-sectional view of the liquid container including the double cap structure according to one embodiment of the present invention, FIG. 3 is a cross-sectional view illustrating a state in which an inner cap of the liquid container including the double cap structure according to one embodiment of the present invention is closed, FIG. 4 is a cross-sectional view illustrating a state in which the inner cap of the liquid container including the double cap structure according to one embodiment of the present invention is opened, FIG. 5 is a cross-sectional view illustrating another example of a stopper accommodation groove of the liquid container including the double cap structure according to one embodiment of the present invention, FIG. 6 is an exploded perspective view illustrating an outer cap and the inner cap of the liquid container including the double cap structure according to one embodiment of the present invention, and FIG. 7 is an exploded perspective view illustrating another example of the outer cap and the inner cap of the liquid container including the double cap structure according to one embodiment of the present invention.

As shown in FIGS. 1 to 7, a liquid container including a double cap structure according to one embodiment of the present invention includes a container body 100, an external cover 200, an outer cap 300, and an inner cap 400.

The container body 100 is for containing a liquid, more particularly, a drink and includes an inner space 110 which accommodates the liquid and an opening 120 formed at a top to allow the liquid to move into or out of the inner space 110. In the embodiment, a protrusion 130 which protrudes inward may be formed between the inner space 110 and the opening 120. In other words, the inner space 110 and the opening 120 may be distinguished from each other by the protrusion 130. The protrusion 130 may be in contact with the outer cap 300, which will be described below, to prevent the liquid accommodated in the inner space 110 from leaking between the container body 100 and the outer cap 300.

Meanwhile, a screw 102 for coupling with the outer cap 300 may be formed at the container body 100 on an inner circumferential surface of the opening 120. Also, a screw 104 for coupling with the external cover 200 may be formed on an outer circumferential surface of the opening 120.

The external cover 200 is coupled with the top of the container body 100, and for this, may include a screw 202 to be coupled with the screw 104 formed at the container body 100. Also, the external cover 200 may be provided to cover the outer cap 300 and the inner cap 400 at an outside thereof to prevent an inflow of foreign substances from the outside into the container body 100 and prevent the outer cap 300 and the inner cap 400 from being contaminated. Also, the liquid in the container body 100 may be prevented from leaking out thereof. The external cover 200 may be separated from the container body 100 and be used as a cup.

The outer cap 300 is fastened to the opening 120 of the container body 100 and includes a liquid port 302 connected to the inner space 110 and having a hollow shape. In the embodiment, an upper part of the liquid port 302 may be formed to allow a diameter thereof to be increased to the top. The liquid port 302 may have an upper diameter that is greater than a lower diameter. Due to this, when the container body 100 is tilted to discharge the liquid, it is possible to prevent the liquid from flowing along a handle portion 420 of the inner cap 400 which will be described below.

A screw 310 for being fastened to the screw 102 of the container body 100 may be formed on an outer circumferential surface of the outer cap 300. Also, a sealing portion 350 formed of an elastic material may be provided at a part in contact with the protrusion 130 below the outer cap 300. The sealing portion 350 comes into contact with the protrusion 130 and is compressed when the outer cap 300 is screw-coupled with the container body 100 such that the liquid accommodated in the inner space 110 may be prevented from leaking between the container body 100 and the outer cap 300. The sealing portion 350 may employ silicone, rubber, and the like but is not limited thereto, and any materials capable of preventing a liquid leakage by compression may be applied to the sealing portion 350.

Also, a bottom surface of the outer cap 300 may be covered by a corrosion-protecting portion 340 which includes a corrosion-resistant material. Since the corrosion-protecting portion 340 is provided on the bottom surface of the outer cap 300 in direct contact with a liquid, the outer cap 300 may be prevented from being corroded by the liquid. For example, stainless steel may be applied to the material of the corrosion-protecting portion 340. However, the material of the corrosion-protecting portion 340 is not limited to stainless steel, and any one having corrosion resistance and simultaneously hardness may be applied thereto.

A coupling screw 320 fastened to the inner cap 400, which will be described below, may be formed on an inner circumferential surface of the outer cap 300.

Also, a holding protrusion 330 which protrudes toward an inside of the liquid port 302 may be formed at a bottom of the inner circumferential surface of the outer cap 300. The holding protrusion 330 may have a ring shape extended lengthwise along a circumferential direction. The holding protrusion 330 may come into contact with a bottom of the inner cap 400 and prevent the liquid accommodated in the inner space 110 from leaking between the outer cap 300 and the inner cap 400 when the inner cap 400 which will be described below is closed.

A stopper accommodation groove 332 may be formed at an edge of the liquid port 302 on the bottom surface of the outer cap 300. Also, when the inner cap 400 is opened, a stopper 434, which will be described below, may be supported by the stopper accommodation groove 332 and limit a movement distance of the inner cap 400.

For example, as shown in FIGS. 3 and 4, the stopper accommodation groove 332 may be formed to be recessed at the edge of the liquid port 302 on the bottom surface of the outer cap 300. Otherwise, as shown in FIG. 5, on the bottom surface of the outer cap 300, an annular protrusion 334 may be formed at the edge of the liquid port 302 to protrude downward, and the stopper accommodation groove 332 in which the stopper 434 is accommodated may be formed on an inside of the annular protrusion 334.

A diameter of the stopper accommodation groove 332 may be formed to be larger than an outer perimeter of the stopper 434. Accordingly, the stopper 434 is accommodated in the stopper accommodation groove 332 such that the stopper 434 may be moved to a central position. The stopper 434 is positioned at a center of the stopper accommodation groove 332 such that the inner cap 400 may be positioned at a center of the liquid port 302. That is, the stopper accommodation groove 332 may function as a centralizer of the inner cap 400. Due to this, since the inner cap 400 does not lean to one side regardless of an operation of tilting the container body 100, the liquid may be discharged in all directions of 360 degrees. The stopper 434 will be described below in detail.

The above-described corrosion-protecting portion 340 may be extended to cover from the bottom surface of the outer cap 300 to the stopper accommodation groove 332 and the holding protrusion 330 of the outer cap 300.

Meanwhile, the inner cap 400 is inserted into the liquid port 302 and fastened to the outer cap 300 to open and close the liquid port 302 to selectively connect the inner space 110 to the outside. The inner cap 400 may include an insertion portion 410 inserted into the liquid port 302 and positioned in the outer cap 300 and the handle portion 420 positioned above the insertion portion 410 and exposed outside the outer cap 300 to be gripped by a user to rotate the inner cap 400.

A coupling screw 412 for being coupled with the coupling screw 320 formed on the inner circumferential surface of the outer cap 300 may be formed to protrude from an outer circumferential surface of the insertion portion 410. That is, when screw-coupling of the inner cap 400 is released by rotation, the inner cap 400 moves upward with respect to the outer cap 300 to open the liquid port 302. On the other hand, when the inner cap 400 rotates in an opposite direction and is screw-coupled with the outer cap 300, a bottom end thereof comes into close contact with the holding protrusion 330 of the outer cap 300 to close the liquid port 302.

A first sealing portion 432 may be provided at a part in contact with the holding protrusion 330 at a bottom end of the insertion portion 410 to seal the inner space 110 when the inner cap 400 is completely closed. The first sealing portion 432 may be formed of an elastic material and be compressed by the holding protrusion 330 to block inflow and outflow of the liquid when the inner cap 400 is closed. To increase a sealing effect, the first sealing portion 432 may include an elastic protrusion which is pressurized by the holding protrusion 330 and deformed in an inward-radial direction when the inner cap 400 is completely closed.

Also, a second sealing portion 440 may be provided between the insertion portion 410 and the handle portion 420 to prevent a liquid present between the inner cap 400 and the outer cap 300 from leaking outward when the inner cap 400 is completely closed. The second sealing portion 440 may protrude outside the inner cap 400 and may be formed of an elastic material. Also, since the second sealing portion 440 comes into contact with the inner circumferential surface of the outer cap 300 and is compressed when the inner cap 400 is completely closed, an outflow of the liquid may be prevented. When the inner cap 400 is opened, the liquid port 302 may be opened to discharge the liquid outward.

The first sealing portion 432 and the second sealing portion 440 may be formed of rubber, silicone, and the like but are not limited thereto.

Also, the insertion portion 410 includes the stopper 434, which limits the movement distance of the inner cap 400 when the inner cap 400 moves upward and is provided at a position spaced at a certain interval apart from a bottom surface of the insertion portion 410. Due thereto, when the inner cap 400 moves upward by a certain distance due to rotation, the stopper 434 may be held and supported by the holding protrusion 330 such that a movement of the inner cap 400 may be limited.

For this, the stopper 434 may protrude in an outward-radial direction and be formed to allow the bottom surface of the outer cap 300 to come into contact with a plurality of lines or surfaces when the inner cap 400 moves upward.

For example, as shown in FIG. 6, the stopper 434 may have a shape including a plurality of protrusions which are spaced at certain angles apart and protrude in the outward-radial direction. The plurality of protrusions may include three or more protrusions.

Otherwise, as shown in FIG. 7, the stopper 434 may have a circular plate shape which protrudes in the outward-radial direction and may include holes 435, through which the liquid passes, to discharge the liquid outward. That is, the stopper 434 may have a filter shape. Due to the above-described shape, the stopper 434 may filter out tea leaves or may prevent foreign substances included in the liquid from being discharged outward with the liquid.

The stopper 434 may be accommodated in the stopper accommodation groove 332 and restricted in a horizontal movement. An upper portion of the stopper 434 may be upwardly projected and directly accommodated in the stopper accommodation groove 332. Due thereto, the inner cap 400 may be located in a dead center of the outer cap 300 to allow the liquid to be discharged in all directions regardless of a direction in which the container body 100 is tilted.

Figure 8:
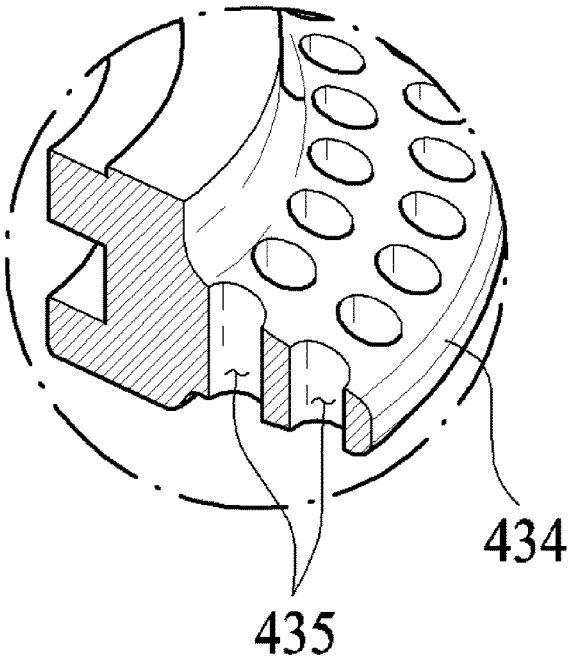
FIG. 8 is a cross-sectional view taken along line II-II of FIG. 7.

In the embodiment, as shown in FIG. 8, it has been described as an example that the stopper 434 has a protrusion shape or a circular plate shape with the holes 435. However, the shape of the stopper 434 is not limited to the above description and may include any shapes capable of being accommodated in the stopper accommodation groove 332 and restricting the movement distance of the inner cap 400 and simultaneously smoothly discharging the liquid.

In the embodiment, the stopper 434 is formed of an elastic material such that the inner cap 400 may be separated from the outer cap 300 by a certain external force applied to the inner cap 400. In other words, when the inner cap 400 is rotated by applying a greater force to the inner cap 400 while the stopper 434 is in contact with the stopper accommodation groove 332, the stopper 434 may be deformed and the inner cap 400 may be separated from the container body 100. Due thereto, the outer cap 300 and the inner cap 400 may be easily washed, and the inner cap 400 may be removed to refill the container body 100 with a liquid through the liquid port 302.

The stopper 434 may be integrated or uniformly formed with the above-described first sealing portion 432 and may be detachably coupled with a bottom of the insertion portion 410. In this case, there is provided an advantage in which it is possible to wash and replace components. Otherwise, the stopper 434 and the first sealing portion 432 may be doubly injection-molded to the inner cap 400. Otherwise, the stopper 434 and the first sealing portion 432 may be formed separately from each other and may be assembled with each other.

Meanwhile, an extraction flow path 414 may be formed to be recessed in a vertical direction on the outer circumferential surface of the insertion portion 410. When the inner cap 400 is opened, the extraction flow path 414 may connect the inner space 110 to the outside to allow a liquid to be discharged outward through the extraction flow path 414. The extraction flow path 414 may have a groove shape which has a length in a height direction of the inner cap 400 and is recessed inside the inner cap 400 at a certain depth. That is, the coupling screw 412 formed at the insertion portion 410 may be cut off by the extraction flow path 414.

Due thereto, when the inner cap 400 is opened any bit, a space may be formed between the holding protrusion 330 and the first sealing portion 432 and may be connected to the extraction flow path 414. Also, the extraction flow path 414 may be connected to a space between the inner circumferential surface of the outer cap 300, at which the coupling screw 320 is not formed, and the outer circumferential surface of the insertion portion 410. Due thereto, the liquid which flows through the extraction flow path 414 may be discharged in all directions of 360 degrees.

As described above, the liquid container including the double cap structure according to one embodiment of the present invention has been described.

Hereinafter, coupling and releasing between the outer cap 300 and the inner cap 400 of the liquid container including the double cap structure according to one embodiment of the present invention will be described.

When the outer cap 300 and the inner cap 400 are coupled with the container body 100, first, the inner cap 400 may be inserted into the liquid port 302 and rotated to be coupled therewith. When the stopper 434 comes into contact with the holding protrusion 330, the inner cap 400 may be rotated with a greater force. Due thereto, the stopper 434 formed of an elastic material may be deformed to pass through the holding protrusion 330 and may be inserted. Also, in this state, when the inner cap 400 is rotated until not to be rotated any more, as shown in FIG. 4, the first sealing portion 432 is compressed such that a gap between the outer cap 300 and the inner cap 400 may be completely sealed.

Also, the outer cap 300 completely coupled with the inner cap 400 may be inserted into the opening 120 of the container body 100 and rotated to couple the outer cap 300 and the inner cap 400 with the container body 100.

On the other hand, when the inner cap 400 is opened to discharge a liquid, the inner cap 400 is rotated to release screw-coupling thereof. As shown in FIG. 5, when the stopper 434 comes into contact with the stopper accommodation groove 332, the inner cap 400 is located in the center of the liquid port 302 and the extraction flow path 414 is opened to become a state of discharging the liquid in all directions.

Here, when the container body 100 is tilted, the liquid accommodated in the inner space 110 may flow into a space between the outer cap 300 and the inner cap 400 through the extraction flow path 414 and may be discharged in all directions of 360 degrees.

When the inner cap 400 is rotated with a greater force while the stopper 434 is in contact with the stopper accommodation groove 332, the stopper 434 may be deformed to separate the inner cap 400 from the container body 100.

According to the above-described embodiments of the present invention, there are provided effects as follows.

First, in a liquid container including a double cap structure according to one embodiment of the present invention, since a stopper formed on a bottom surface of an inner cap, at a position spaced at a certain distance apart from the bottom surface of the inner cap, and supported by a bottom surface of an outer cap to limit a moving distance of the inner cap when the inner cap moves up by a certain distance or more is provided, the inner cap may be prevented from being separated when a liquid is discharged.

Second, in a liquid container including a double cap structure according to one embodiment of the present invention, since a stopper accommodation groove in which a stopper is accommodated is formed on a bottom surface of an outer cap and functions as a centralizer to allow an inner cap to be constantly positioned at a center of a liquid port, the inner cap does not lean to one side even when a container body is tilted such that a liquid may be discharged in all directions of 360 degrees.

Third, in a liquid container including a double cap structure according to one embodiment of the present invention, since a stopper is formed of an elastic material, when a certain external force is applied to an inner cap, the stopper is deformed and the inner cap is separated from an outer cap such that washing, replacing, drink-refilling, and the like may be easily performed.

Effects of the present disclosure will not be limited to the above-mentioned effects and other unmentioned effects will be clearly understood by those skilled in the art from the following claims.

Although the exemplary embodiment of the present invention has been described above, it is obvious to one of ordinary skill in the art that the present invention may be embodied as other particular forms in addition to the above-described embodiment without departing from the purpose or scope of the present invention. Therefore, the above-described embodiment should be considered to be exemplary rather than limitative and thus the present invention is not limited to the above description and may be modified within the scope of the following claims and equivalents thereof.

What is claimed is:

1. A liquid container comprising:

a container body comprising an inner space, an opening, and a protrusion which protrudes inward between the inner space and the opening;

an outer cap mounted to the container body through a screw-coupling, the outer cap including a liquid port connected to the inner space, wherein a coupling screw is formed on an inner circumferential surface of the outer cap, a holding protrusion which protrudes inward formed between the inner space and the liquid port, wherein the liquid port has an upper diameter that is greater than a lower diameter, wherein a stopper accommodation groove is formed on a bottom surface of the holding protrusion, wherein an annular protrusion protrudes downward and the stopper accommodation groove is formed on an inside of the annular protrusion;

an inner cap comprising an insertion portion inserted into the liquid port and with an extraction flow path, the extraction flow path formed to be recessed in a vertical direction on an outer circumferential surface of the insertion portion, a handle portion located above the insertion portion and exposed outward from the outer cap, and a first sealing portion formed of an elastic material at a bottom end of the insertion portion and compressed by the holding protrusion to seal the inner space when the inner cap is completely closed; and a stopper is uniformly formed with the first sealing portion and protrudes in an outward radial direction, wherein the stopper is configured to be accommodated in the stopper accommodation groove when the inner cap moves upward so that a horizontal movement of the stopper is prevented, and formed of an elastic material to allow the inner cap to be removable from the outer cap, wherein an upper portion of the stopper is upwardly projected and directly accommodated in the stopper accommodation groove.

2. The liquid container of claim 1, wherein the inner cap further comprises a second sealing portion formed of an elastic material between the insertion portion and the handle portion, extended along an outer diameter to protrude outward to come into contact with an inner circumferential surface of the outer cap to be compressed when the inner cap is completely closed.

* * * * *